United States Patent [19]

Kimmel et al.

[11] Patent Number: 4,942,334

[45] Date of Patent: Jul. 17, 1990

[54] ELECTRON-GUN SYSTEM

[75] Inventors: Helmut Kimmel, Esslingen; Hans Reule, Wendlingen, both of Fed. Rep. of Germany

[73] Assignee: Nokia Graetz, Pforzheim, Fed. Rep. of Germany

[21] Appl. No.: 200,606

[22] Filed: May 31, 1988

[30] Foreign Application Priority Data

Jun. 5, 1987 [DE] Fed. Rep. of Germany ..... 3718838

[51] Int. Cl.[5] ..... H01J 29/51

[52] U.S. Cl. ..... 313/414; 313/448

[58] Field of Search ..... 313/414, 448, 409, 412

[56] References Cited

U.S. PATENT DOCUMENTS

| | | | |
|---|---|---|---|
| 3,295,001 | 12/1966 | Burdick | 313/448 |
| 4,234,814 | 11/1980 | Chen et al. | 313/414 X |
| 4,500,808 | 2/1985 | McCandless | 313/409 |
| 4,514,659 | 4/1985 | Chen | 313/412 |
| 4,520,292 | 5/1985 | van Hekken et al. | 313/412 |
| 4,523,123 | 6/1985 | Chen | 313/412 |
| 4,535,266 | 8/1985 | Say | 313/414 |
| 4,608,515 | 8/1986 | Chen | 313/414 X |

*Primary Examiner*—Sandra L. O'Shea

*Attorney, Agent, or Firm*—Peter C. Van Der Sluys

[57] ABSTRACT

In a cathode-ray tube with a thick grid No. 2 (24) in the electron-gun system, current transfer into grid No. 2 (24) may result in a lack of picture sharpness. To avoid this error, the aperture (4) in grid No. 2 (24) has a widening (6) of conical shape or stepped diameter.

6 Claims, 3 Drawing Sheets

ELECTRON-GUN SYSTEM

The present invention relates to an electron-gun system for cathode-ray tubes and more particularly, an electron gun system having at least one cathode and at least three electrodes which are arranged one behind the other and have apertures through each of which an electron beam can pass.

Electron-gun systems for cathode-ray tubes comprising a cathode as well as grid and focusing electrodes are known from (DE-OS 32 12 248) corresponding to U.S. Pat. No. 4,682,073. To achieve a thin electron beam and, thus, a small electron spot on the screen of the cathode-ray tube, it is necessary to make grid No. 2 relatively thick. This means that the aperture in grid No. 2 must have a great depth, it being quite possible that the depth of the aperture is equal to the diameter of the aperture.

With such a design of grid No. 2, it may happen that during the period from the turning on of the cathode-ray tube to the creation of stable space-charge conditions around the cathode, the electron beam expands, touching the wall of the aperture in grid No. 2. The electrons touching the wall of the aperture in grid No. 2 cause the emission of secondary electrons which reach grid No. 3, also called "focusing electrode". Such leakage currents are first unmeasurably small, but with increasing service life, measurable currents in the pA range occur at grid Nos. 2 and 3 for short times because due to deposition of evaporated cathode materials into the aperture of grid No. 2, the secondary-electron yield of initially about 1 multiplies. These leakage currents cause a change in the voltage across grid No. 2 - it becomes more positive - and in the voltage across the focusing electrode, which becomes more negative. Due to these changes in potential, the electron beam is not optimally focused for short periods of time, which leads to a lack of picture sharpness. In unfavorable cases, even self-blocking may be caused by total current transfer into grid Nos. 2 and 3.

It is the object of the present invention to provide an electron-gun system for cathode-ray tubes having a thick grid No. 2 in which no lack of picture sharpness is caused by current transfer into grid Nos. 2 and 3.

This object is attained by making the aperture in grid No. 2 so that it becomes wider at its side facing grid No. 3. Further advantageous features of the invention are achieved by making the aperture widening conical in shape, and in particular, that the conical widening extends over part of the depth of the aperture, and that the other part of the depth satisfies the relation a divided by d is less than or equal to 0.5, where d is the diameter of the aperture and a is the depth of the unwidened part of the aperture. Other features of the invention include the widening of the aperture has an angle of at least 10°, and preferably 15°. In another embodiment, the side of grid No. 2 facing grid No. 3 bears a plate containing the conical widening. The widening may also be in the form of a step, wherein the diameter of the widened part between the step and the side of the grid facing grid No. 3 satisfies the relationship $d1=d0+2c \cdot \tan\alpha$, where d0 is the diameter of the unwidened part of the aperture, c is the depth of the widened part, and $\alpha$ is greater than or equal to 10°.

Embodiments of the invention will now be explained with reference to the accompanying drawings, in which.

Figure 6:
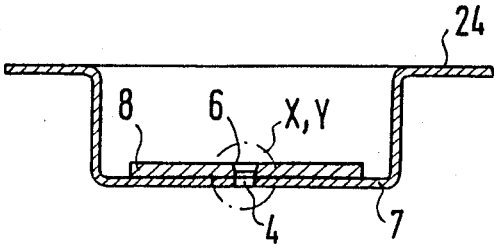
FIG. 6 is a cross-sectional view of a third embodiment of a grid No 2.
Figure 7A:
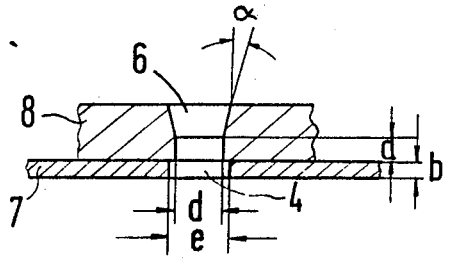
Figure 7B:
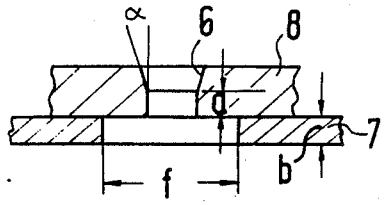
Figure 8:
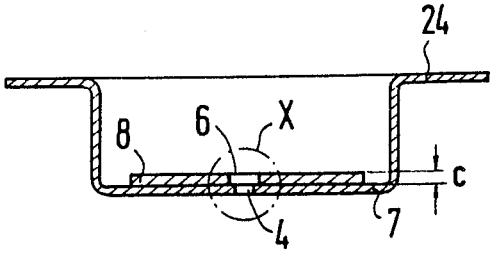

FIGS. 7*a* and 7*b* show the details X and Y of FIG. 6;

FIG. 8 is a cross-sectional view of a further embodiment, and

Figure 9:
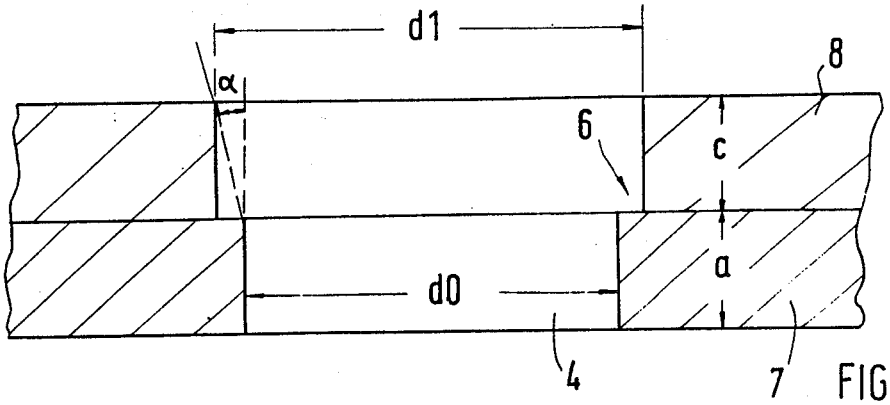

FIG. 9 shows the detail X of FIG. 8.

Figure 1:
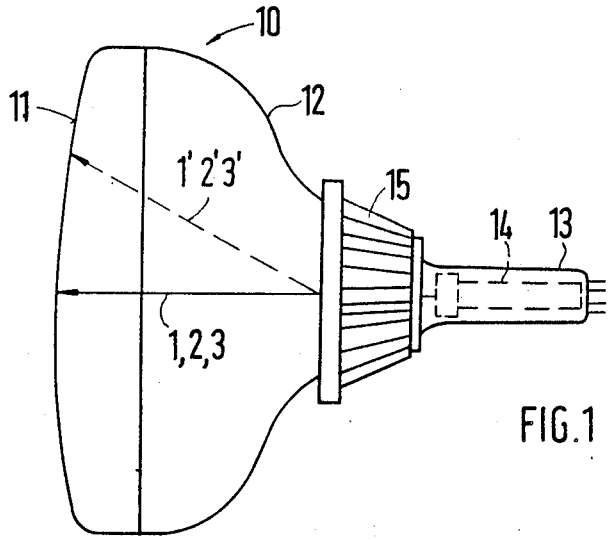
FIG. 1 is a side view of a cathode-ray tube.

FIG. 1 shows a cathode-ray tube 10 comprising a screen 11, a funnel section 12, and a neck 13. There are singlegun and multigun tubes. In multigun tubes, the electron guns are either separate from each other or combined into one mechanical assembly The present invention relates to all these forms of electron-gun systems even though it will be explained as applied to a multibeam electron-gun system of integrated construction.

The neck 13 of the cathode-ray tube 10 houses an electrongun system 14 (indicated by broken lines) which generates three electron beams 1, 2, 3 These beams are scanned (1', 2', 3') across the screen 11 by a magnetic deflection system 15 located in the junction region of the funnel section 12 with the neck 13.

Figure 2:
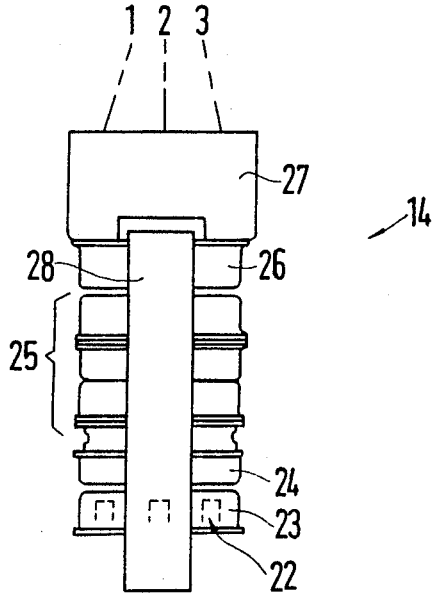
FIG. 2 is a side view of an electron-gun system.

FIG. 2 shows the electron-gun system 14 in a side view. Seen in the beam direction, the system 14 comprises a grid No 1, designated 23, a grid No. 2, 24, first and second focusing electrodes 25 and 26, and a convergence cup 27. Grid No. 1, 23, contains cathodes 22, which are indicated by dashed lines This grid is also called the "control grid", and grid No. 2, 24, the "screen grid". The cathode, the control grid, and the screen grid are referred to as a "triode lens"The focusing electrodes 25, 26 constitute a focusing lens. The individual parts of the system are held together by two glass rods 28 The electrical connections of the system 14 are not shown for the sake of clarity.

All electrodes of the system 14 contain three apertures which are arranged in a horizontal line and through which can pass the electron beams generated by the three cathodes 22, which later land on the phosphor screen 11.

Figure 3:
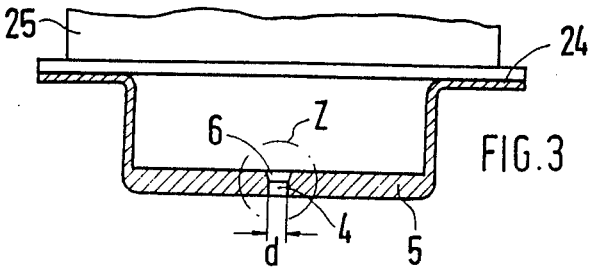
FIG. 3 is a cross-sectional view of a first embodiment of a grid No. 2.

FIG. 3 shows grid No. 2, 24, in a sectional view. Indicated above this grid is the first focusing electrode 25. In this embodiment, grid No. 2 has the shape of a cup whose bottom 5 contains the aperture 4 for the electron beam. The other apertures for the other electron beams are not visible in this sectional view. The aperture 4 has a great depth, i.e., its diameter d is approximately equal to the thickness of the bottom 5 of the grid. On the side of the grid facing the first focusing electrode 25, the aperture 4 has a widening 6 which is conical in shape.

Figure 4:
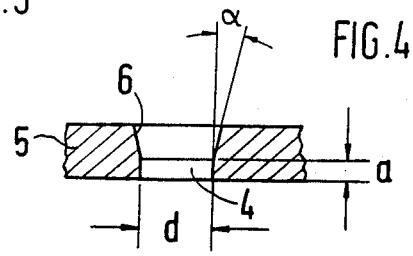
FIG. 4 shows the detail Z of FIG. 3.

FIG. 4 shows the detail Z of FIG. 3. The conical widening 6 need not extend over the entire depth of the aperture 4. In the example shown, the aperture 4 has a depth a over which its sidewalls are parallel to the central axis of the aperture 4. This portion is followed by the conical widening 6. The conical widening has an angle $\alpha$ of at least 10°, preferably 15°. For the relation of the depth a of the aperture 4 to the diameter d, the condition $a/b \leqq 0.5$ should be satisfied.

Figure 5:
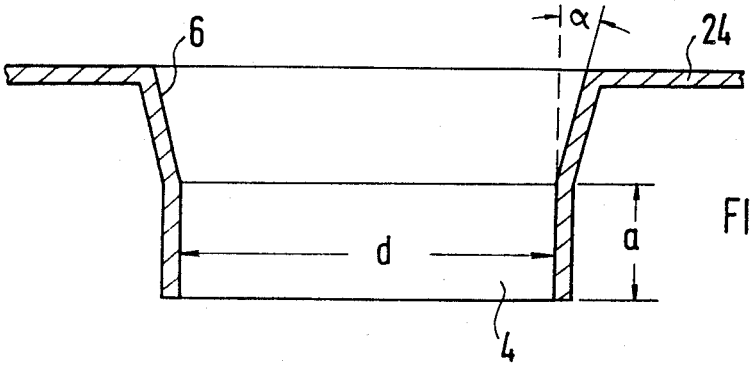
FIG. 5 is a cross-sectional view of a second embodiment of a grid No. 2.

FIG. 5 shows a second embodiment of grid No. 2. In this embodiment, grid No. 2 is made from thin metal sheet. Here, too, the conical widening 6 includes an angle $\alpha$ of at least 1O°, and the relation $a/d \leqq 0.5$ is satisfied.

FIG. 6 shows a third embodiment of grid No. 2. It has the shape of a cup, and the bottom 7 of the cup contains the rectangular aperture 4. A plate 8 resting on the bottom 7 contains an aperture aligned with the aperture 4 and having a conical widening 6. This structure of grid No. 2 permits an astigmatic beamforming element in the grid to be combined in a simple manner with the plate 8 containing the conical widening 6.

FIGS. 7*a* and 7*b* show the details X and Y, respectively, of FIG. 6. The details X and Y represent two sections through the grid 24 which are displaced relative to each other by 9O°. The plate 8 contains a rotationally symmetric aperture consisting of a cylindrical portion of depth a and the conical widening 6. The widening again has an angle $\alpha$ of at least 1O°. It does not extend over the entire depth of the aperture but passes into the portion whose depth is designated a and whose sidewalls are parallel to the central axis of the aperture 4. Here, too, the condition $a/d \leqq = 0.5$ should be satisfied. The depth of the aperture 4 in the bottom 7 is designated by b, the width by e, and the length by f, and this portion of the aperture acts as an astigmatic beam hole.

FIG. 8 shows a further embodiment of grid No. 2. Here, the widening 6 is formed by a step, and its depth is designated c. In this embodiment, too, the grid can have the shape of a cup whose bottom 7 contains the aperture 4. The bottom 7 then bears the plate S, whose aperture is aligned with the aperture 4 and has the diameter d1 (FIG. 9). This diameter is greater than the diameter dO of the aperture in the bottom 7, so that the step is obtained Here, the condition $d1 = d0 + 2c \cdot \tan\alpha$ should be satisfied, where $\alpha \geqq 10°$. FIG. 9 shows the detail X of FIG. 8. In this embodiment, too, the bottom 7 may contain a rectangular aperture which acts as an astigmatic beam hole.

We claim:

1. Electron-gun system for cathode-ray tubes comprising at least one cathode and at least three electrodes, the second of which is a screen grid, which are arranged one behind the other and have apertures through each of which an electron beam can pass, characterized in that the aperture (4) in the screen grid (24) has an unwidened part and a conical widening (6) on its side facing the third electrode (25), whereby current transfer into the screen grid and the third electrode is greatly reduced.

2. An electron gun system for cathode ray tubes, comprising:

at least one cathode;

at least three electrodes, said electrodes and said cathode being arranged one behind the other and having apertures through each of which an electron beam can pass, the aperture of the second electrode having a widening on its side facing the third electrode, said widening being conical in shape and extending over part of the depth of the aperture, and that the other part of the depth satisfies the relationship a divided by d is less than or equal to 0.5, where d is the diameter of the unwidened part of the aperture and a is the depth of the unwidened part of the aperture.

3. An electron-gun system as claimed in claim 2, characterized in that on its side facing the third electrode (25), in the area of the opening (4), the second electrode (24) bears a plate (8) containing the conical widening (6).

4. An electron gun system for cathode ray tubes, comprising:

at least one cathode;

5. An electron gun system for cathode ray tubes, comprising:

at least one cathode;

at least three electrodes, said electrodes and said cathode being arranged one behind the other and having apertures through each of which an electron beam can pass, the apertures of the second electrode having widenings on sides facing the third electrode, each of said widenings being formed by a step wherein the diameter (d1) of the widened part satisfies the relation $d1 = d0 + 2c \cdot \tan\alpha$, where d0 is the diameter of the unwidened part of the aperture (4), c is the depth of the widened part, and $\alpha \geqq 10°$.

6. Electron-gun system for cathode-ray tubes comprising at least one cathode and at least three electrodes, the second of which is a screen grid, which are arranged one behind the other and have apertures defined by cylindrical surfaces through each of which an electron beam can pass, characterized in that the aperture (4) in the screen grid (24) has a conical widening defined by a conical surface contiguous with the cylindrical surface on its side facing the third electrode (25), whereby current transfer into the screen grid and the third electrode is greatly reduced.

* * * * *

UNITED STATES PATENT AND TRADEMARK OFFICE

CERTIFICATE OF CORRECTION

PATENT NO. : 4,942,334

DATED : July 17, 1990

INVENTOR(S) : H. Kimmel and H. Reule

It is certified that error appears in the above-identified patent and that said Letters Patent is hereby corrected as shown below:

At column 4, after line 25, please insert:

--at least three electrodes, said electrodes and said cathode being arranged one behind the other and having apertures through each of which an electron beam can pass, the aperture of the second electrode having a widening on its side facing the third electrode, said widening being conical in shape and having an angle of at least $10^{\circ}$.--

Signed and Sealed this

Seventeenth Day of September, 1991

*Attest:*

HARRY F. MANBECK, JR.

*Attesting Officer*

*Commissioner of Patents and Trademarks*